US005780762A

United States Patent [19]

Kobayashi

[11] Patent Number: 5,780,762

[45] Date of Patent: Jul. 14, 1998

[54] CONTINUOUS SHOOTING DEVICE AND GUN OR TOY GUN

[75] Inventor: Tazo Kobayashi, Urawa, Japan

[73] Assignee: Tanio Koba Co., Ltd., Urawa, Japan

[21] Appl. No.: 755,125

[22] Filed: Nov. 22, 1996

[30] Foreign Application Priority Data

Nov. 24, 1995 [JP] Japan ..... 7-327901

[51] Int. Cl.[6] ..... F41A 19/09

[52] U.S. Cl. ..... 89/140; 89/136

[58] Field of Search ..... 89/136, 27.3, 140, 89/128; 42/69.01, 69.02, 105, 1.11

[56] References Cited

U.S. PATENT DOCUMENTS

| | | | |
|---|---|---|---|
| 2,308,598 | 1/1943 | Ferrel | 89/140 |
| 2,607,148 | 8/1952 | Simpson | 42/69.01 |
| 3,091,878 | 6/1963 | Savioli | 42/69.01 |
| 3,290,993 | 12/1966 | Irusta | 89/140 |
| 4,514,923 | 5/1985 | Teel | 42/69.01 |

FOREIGN PATENT DOCUMENTS

| | | | |
|---|---|---|---|
| 45119 | 11/1910 | Austria | 89/27.3 |
| 99739 | 4/1925 | Austria | 89/140 |
| 158566 | 2/1933 | Switzerland | 89/27.3 |

*Primary Examiner*—Stephen M. Johnson

*Attorney, Agent, or Firm*—Oblon, Spivak, McClelland, Maier & Neustadt, P. C.

[57] ABSTRACT

A continuous shooting device (22) which is able to be detachably mounted on a real gun or a toy gun having a gun frame (10), a single shot trigger (17) for shooting said gun each time said trigger is depressed, and a slide (13) which is moved first rearward and then forward upon each shooting for supplying a bullet, said continuous shooting device comprises a mounting unit (23) detachably mounted on said gun frame, and a continuous shooting trigger (34) being installed on said mounting unit and movable back and forth, said continuous shooting device is able to make a continuous shooting operation as long as said continuous shooting trigger being depressed.

4 Claims, 4 Drawing Sheets

CONTINUOUS SHOOTING DEVICE AND GUN OR TOY GUN

FIELD OF THE INVENTION

This invention relates to a continuous shooting device and a real gun or a toy gun. The term "gun" can include any kind of firearm, but in following description it will be used more particularly in the sense of "portable fire arm such as pistols, rifles and various kinds of toy guns".

BACKGROUND OF THE INVENTION

In the prior art of a toy gun or a real gun, a semi-automatic gun of a conventional type which is originally not accompanied by a continuous shooting device and can be shooted each time the user depresses its trigger, even when additional parts are added to the gun by the user without modifying the gun in its mechanism, it is impossible for the gun to perform a fully automatic continuous shooting operation.

The Ferrel U.S. Pat. No. 2,308,598 describes a trigger mechanism which has two triggers operable independently of each other. One trigger is a semi-automatic trigger which is depressed at each shooting time by user, and the other trigger functions as an automatic or machine gun trigger. However, the automatic gun trigger can not be detachably mounted to standard guns having only a semi-automatic trigger because a standard semi-automatic trigger differs from Ferrel's such that a standard gun has insufficient space to accommodate Ferrel's automatic trigger.

SUMMARY OF THE INVENTION

It is an object of the present invention to provide a continuous shooting device for shooting a toy or real semi-automatic gun in a fully automatically repeating fashion and also to provide a toy or a real semi-automatic gun on which the continuous shooting device is detachably mounted without modifying the original mechanism of the gun.

For example, as in Japan, in some regions, police personnel are inhibited to have pistols which are a fully automatic continuous shooting fashion. However, even in regions where restrictions are placed on fully automatic weapons, automatic guns may be used by police in dangerous situations. Consequently, it is another object of the present invention to fulfill the above requirements by providing the continuous shooting devices which are detachably mounted on pistols.

This invention provides a continuous shooting device which is able to be detachably mounted on a toy gun or a real gun having a gun frame, a single-shot trigger for shooting a bullet by depressing the trigger at any time, and a slide being moved firstly rearward and then forward upon each shooting for supply a bullet, characterized in that, the continuous shooting device comprises a mounting unit detachably mounted on the gun, a continuous shooting trigger frame installed on the mounting unit and movable back and forth against the mounting unit and having a forward elongated portion, an operating member which is installed on the mounting unit and is movable back and forth against the mounting unit and is brought into contact with the single shot trigger, and a connecting member which is pivotally connected to a forward elongated portion of the continuous shooting trigger at its central portion. The connecting member is pivotally connected to the operating member at its lower portion and has an engaging portion formed at its upper end for contacting the front surface of the lower part of the slide when the slide is in a forward position. When the continuous shooting trigger is depressed, the single shot trigger is depressed by the operating member so as to shoot a bullet, the slide is moved back, and the operating member and the single shot trigger are returned to initial rest positions under the influence of resilient force exerted by a return spring. Then the slide is moved forward and the gun shoots continuously as long as the continuous shooting trigger is depressed.

BRIEF DESCRIPTION OF THE DRAWINGS

Various other objects, features, and attendant advantages of the present invention will be more fully appreciated as the same becomes better understood from the following detailed description when considered in connection with the accompanying drawings and wherein.

DESCRIPTION OF THE PREFERRED EMBODIMENT

Figure 1:
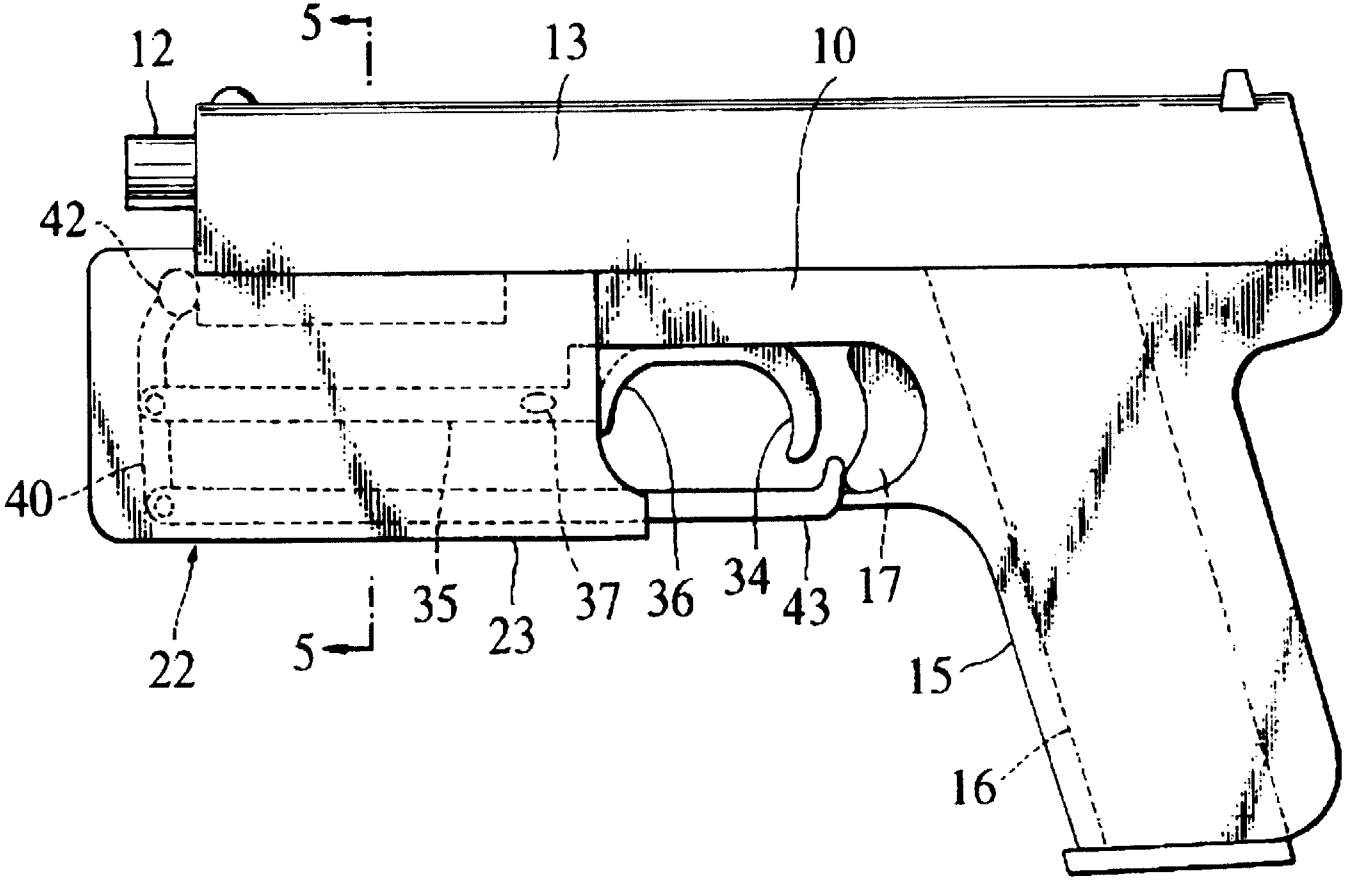
FIG. 1 is a side view of a gun which is an embodiment of the present invention carring the continuously shooting device.
Figure 2:
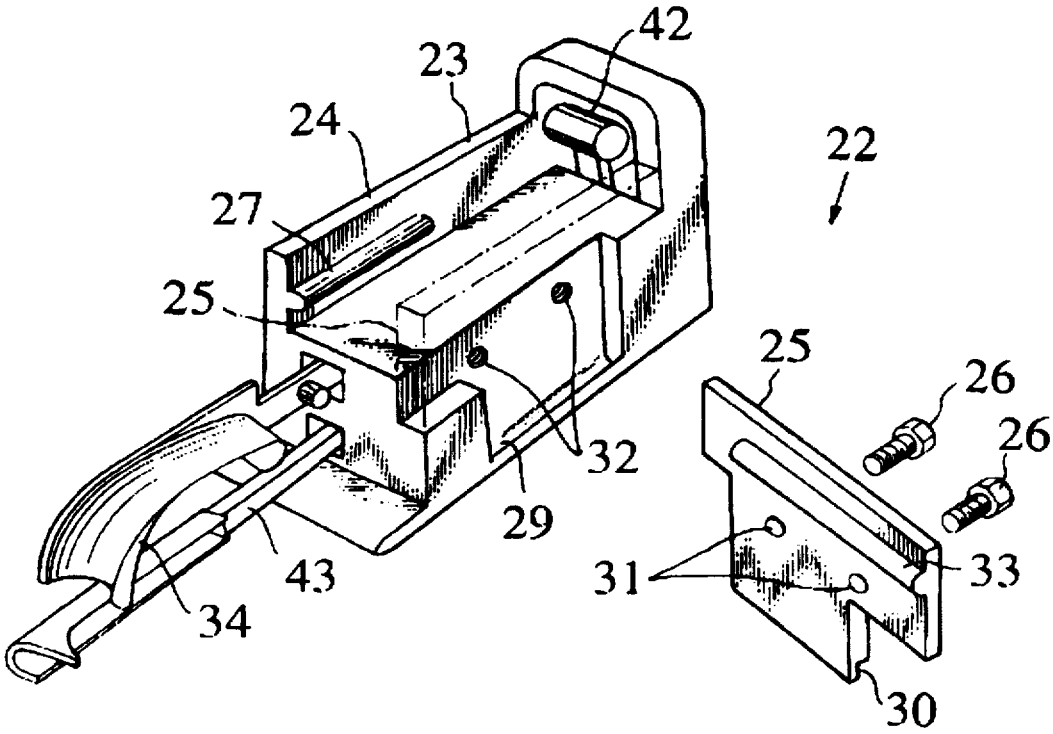
FIG. 2 is an exploded perspective view of the continuous shooting device shown in FIG. 1.
Figure 3:
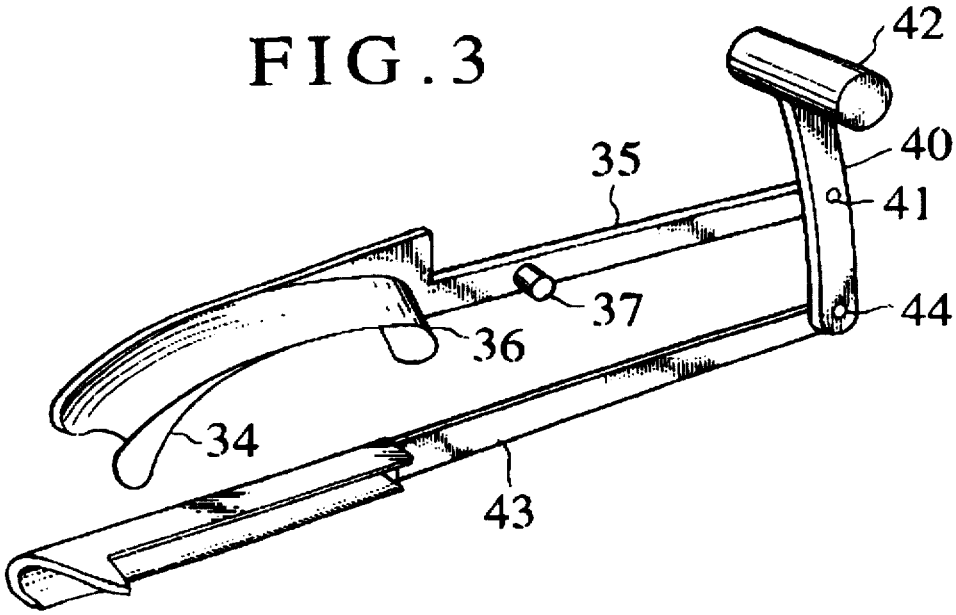
FIG. 3 is an perspective view of an important portion of the continuous shooting device shown in FIG. 2.
Figure 4:
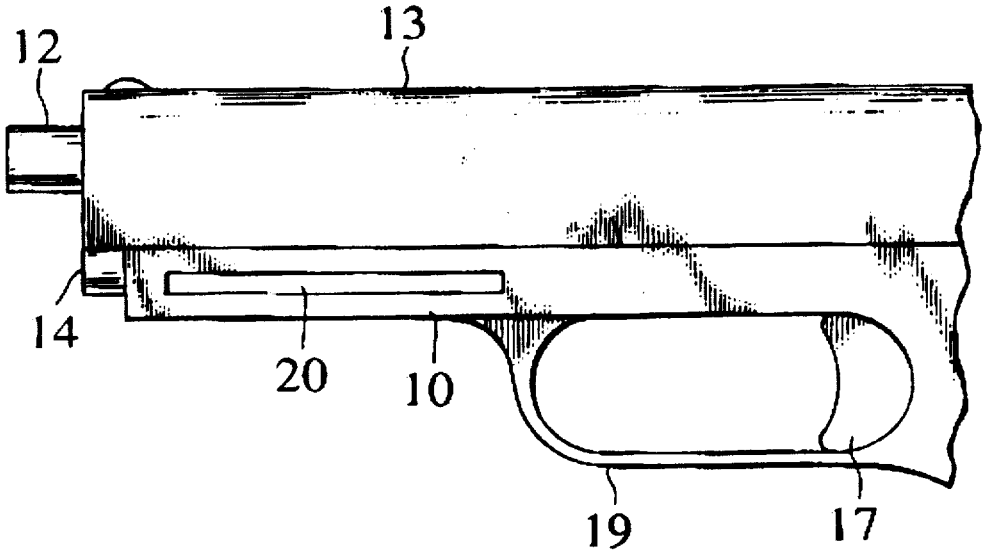
FIG. 4 is a partially removed side view of a gun shown in FIG. 1 and has not the continuous shooting device.
Figure 5:
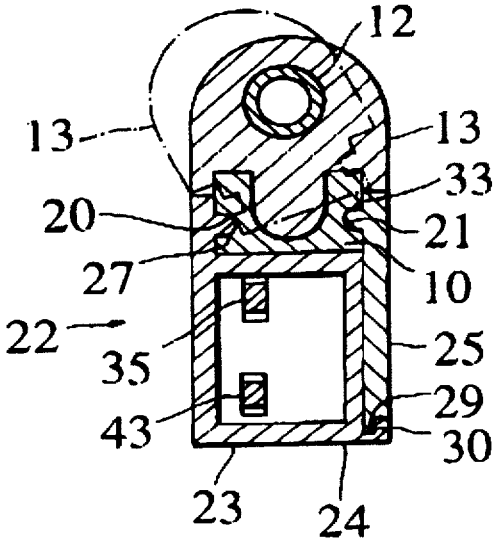
FIG. 5 is a cross sectional view of the gun taken along the line 5—5 of FIG. 1.

Hereinbelow, the present invention will be described in detail with reference to the accompanying drawings in which like reference numerals apply to same parts throughout the several views.

FIGS. 1 to 7 show a gun which may be a toy gun or a real gun. The gun is accompanied by a continuous shooting device 22 of an embodiment of the present invention. The gun has a gun frame 10, a barrel 12 and a slide 13 which is moved back and forth upon each shooting to supply a bullet (not shown) to its shooting position. In operation, the slide 13 is first moved back by the user's hand. When the user releases the slider from his hand, the slide moves forward to supply the bullet to its predetermined shooting position. The slide 13 is provided with a lower part 14. The gun has a grip 15 which receives a magazine 16 therein, and a single shot trigger 17 for shooting each shot upon each depressing operation thereof. The single shot trigger 17 is guarded by a trigger guard 19. The gun frame 10 is provided with a pair of longitudinally extending grooves 20, 21 at its opposite sides.

The continuous shooting device 22 makes the gun to perform a continuous shooting operation. The device 22 is provided with a mounting unit 23 through which the device 22 is detachably mounted on the gun frame 10.

The mounting unit 23 comprises a main body member 24 assuming a substantially box like shape which partially surrounds a lower portion of the gun frame 10 and a fixing member 25 detachably mounted on the main body member 24 through a pair of screws 26. In an inner surface of an upper left hand portion of the main body member 24, a ridge portion 27 is formed, which is smaller in length than the longitudinal groove 20 of the gun frame 10 and is detachably engaged with the groove 20. Further, another longitudinal groove 29 is formed in an inner surface of a lower right hand portion of the main body member 24 for receiving a ridge portion 30 formed in a lower end portion of the fixing member 25. In assembly, the ridge portion 30 of the fixing member 25 is inserted into the longitudinal groove 29 of the main body member 24. Under such circumstances, the screws 26 are inserted into through holes 31 of the fixing member 25 and meshed with a pair of threaded holes 32 of the main body member 24 so that the fixing member 25 is fixedly mounted on the main body member 24. A ridge portion 33 is formed in a inner surface of the fixing member 25 and detachably engaged with longitudinal groove 21 of the gun frame 10. This groove 21 assumes the same shape as that of the other longitudinal groove 20 and is oppositely disposed from the other longitudinal groove 20. Through these longitudinal grooves 20, 21 of the gun frame 10, the continuous shooting device 22 is prevented from moving relative to the gun frame 10 in a longitudinal direction thereof.

A continuous shooting trigger 34 has an extension 35 which passes through the main body member 24 of the continuous shooting device 22 to extend forward in a manner such that the extension 35 is slightly swingable and movable back and forth relative to the main body member 24. When the continuous shooting trigger 34 moves forward relative to the gun frame 10, an contacting portion 36 made at front portion thereof contacts to the back surface of the front portion of the trigger guard 19. An engaging portion 37 of the continuous shooting trigger 34 extends inward from the rear portion of the extension 35, which engages to the front surface of the front portion of the trigger guard 19 when the trigger 34 is depressed.

A connecting member 40 is pivotally connected to the front end portion of the extension 35 at its central portion through a pin 41. An engaging portion 42 is formed at the upper end portion of the connecting member 40, which is brought into contact with a front surface of the lower part 14 of the slide 13. An operating member 43 is pivotally connected to the lower portion of the connecting member 40 through a pin 44 at the front end portion thereof. The operating member 43 is mounted in the main body member 24 in a manner such that the operating member 43 is slightly swingable and movable back and forth relative to the main body member 24. The rear end portion of the operating member 43 is always engaged with the single shot trigger 17 so as to be movable back and forth, and partially surrounds the trigger guard 19.

The continuous shooting device 22 having the above construction is mounted on the gun as follows: Namely, first, as shown in chain lines of FIG. 5, a front portion of the frame 10 of the gun is slightly inclined and then has its left hand side brought into contact with an inner surface of an upper side portion of the main body member 24 of the continuous shooting device 22 which is not accompanied by the fixing member 25, so that the ridge portion 27 provided in the inner surface of the main body member 24 is fitted in the longitudinal groove 20 of the frame 10 of the gun; then, in a condition in which the single shot trigger 17 is depressed, the frame 10 of the gun is rotated clockwise as viewed in FIG. 5 so that the continuous shooting trigger 34 enters in the trigger guard 19 and the operating member 43 is brought into contact with the single shot trigger 17. Under such circumstances, the fixing member 25 is fixedly mounted on the main body member 24 by fastening the screws 26, so that the continuous shooting device 22 is mounted on the frame 10 of the gun.

The continuous shooting device 22 thus mounted on the frame 10 of the gun may be disassembled by reversing the above described assembly procedure, for example as follows: Namely, at first, the screws 26 are removed from the device 22; then, the fixing member 25 is removed from the main body member 24 of the device 22; and, finally, the frame 10 of the gun is rotated counterclockwise (as viewed in FIG. 5) into its inclined position shown in chain lines, so that the frame 10 is removed from the main body member 24 of the device 22.

Figure 6:
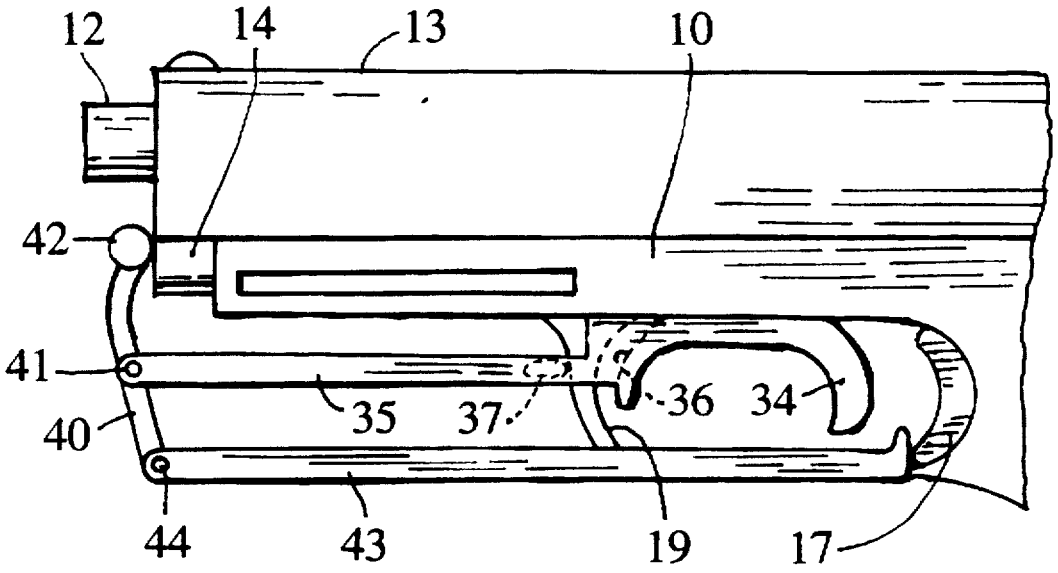
FIG. 6 is a side view of the gun shown in FIG. 1, illustrating an essential parts of the continuous shooting device in a condition in which the continuous shooting trigger is depressed to shoot bullets.
Figure 7:
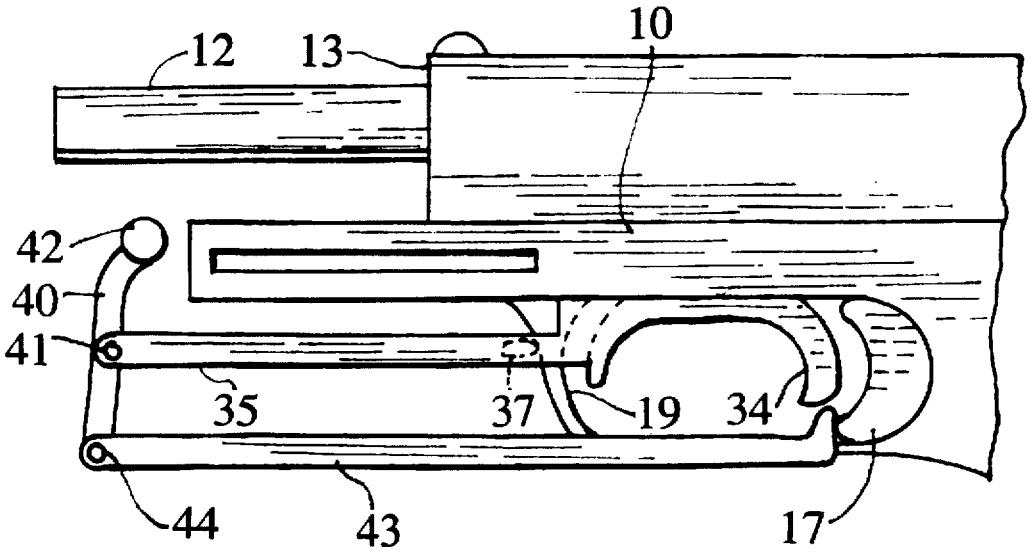
FIG. 7 is a side view of the gun shown in FIG. 1, illustrating an essential parts of the continuous shooting device in a condition in which the slide is retracted after shooting.

In operation, in the gun in which the continuous shooting device 22 is mounted on its frame 10 as described above, when the slide 13 is manually moved back by the user's hand and then released from the hand, the slide 13 automatically returns to its initial rest position. Through this operation, a first bullet (not shown) is transferred from the magazine 16 to its shooting position and stays there. As shown in FIG. 6, the engaging portion 42 is engaged with the front surface of the lower part 14 of the slide 13. Under such circumstances, when the continuous shooting trigger 34 is depressed, the gun operates as follows: Namely, at first, the connecting member 40 is pulled at its central portion through the pin 41 by the extension 35 of the continuous shooting trigger 34, and, therefore rotates on its engaging portion 42 counterclockwise as viewed in FIG. 6. As a result, the operating member 43 is moved rearward to depress the single shot trigger 17, i.e., to shoot the gun. After shooting, the slide 13 is moved back to have its front end portion surface of the lower part 14 disengaged from the engaging portion 42 of the connecting member 40, which permits the single shot trigger 17 to return to its initial rest position under the influence of a resilient force exerted by its return spring (not shown), and, therefore also permits the connecting member 40 to rotate on its central portion's pin 41 clockwise as viewed in FIG. 7. Under such circumstances, the slide 13 returns to its initial rest position shown in FIG. 6 to repeat shooting operation described above. Consequently, so long as the continuous shooting trigger 34 is depressed, the gun performs a fully automatically continuous shooting operation.

According to the present invention, it is possible to sell, as a set, a real or a toy gun with a single shot trigger 17 together with the continuous shooting device 22 which is able to be detachably mounted on the gun.

The foregoing is of course considered as illustrative only of the present invention. Obviously, numerous modifications of the present invention are possible in light of the above teaching.

What is claimed is:

1. A continuous shooting device which can be detachably mounted on a real gun or a toy gun having a gun frame, a single shot trigger for shooting a bullet each time said single shot trigger is depressed, and a slide which is moved first rearward and then forward upon each shot for supplying the bullet, said continuous shooting device comprising:

a mounting unit detachably mounted on said gun frame;

a continuous shooting trigger installed on said mounting unit and movable back and forth against said mounting unit and having a forward extension;

an operating member which is installed on said mounting unit and is movable back and forth against said mounting unit and is brought into contact with said single shot trigger; and a connecting member pivotally connected to said forward extension of said continuous shooting trigger at its central portion and pivotally connected to said operating member at its lower portion, said connecting member having:

an engaging portion formed at an upper end of said connecting member, wherein said engaging portion contacts the front surface of a lower part of said slide when said slide is in the forward position such that when said continuous shooting trigger is depressed, said single shot trigger is depressed by said operating member so as to shoot a bullet, said slide is moved back, said operating member and said single shot trigger are returned to initial rest positions under the influence of a resilient force exerted by a return spring of said single shot trigger, said slide is moved forward, and the gun shoots continuously as long as said continuous shooting trigger is depressed.

2. A continuous shooting device as set forth in claim 1, wherein said mounting unit further comprises:

a substantially box-shaped main body member partially surrounding a lower portion of the gun frame; and a fixing member detachably mounted on the main body member with screws.

3. A real gun or a toy gun comprising:

a gun frame;

a single shot trigger for shooting said gun each time said single shot trigger is depressed;

a slide which is moved first to a rearward position and then to a forward position to supply a bullet each time the gun is fired, and a detachably mounted continuous shooting device including:

a mounting unit detachably mounted on said gun frame;

a continuous shooting trigger installed on said mounting unit and movable back and forth against said mounting unit and having a forward extension;

an operating member which is installed on said mounting unit and is movable back and forth against said mounting unit and is brought into contact with said single shot trigger; and a connecting member pivotally connected to said forward extension of said continuous shooting trigger at its central portion and pivotally connected to said operating member at its lower portion, said connecting member having:

an engaging portion formed at an upper end of said connecting member, wherein said engaging portion contacts the front surface of a lower part of said slide when said slide is in the forward position such that when said continuous shooting trigger is depressed, said single shot trigger is depressed by said operating member so as to shoot a bullet, said slide is moved back, said operating member and said single shot trigger are returned to initial rest positions under the influence of a resilient force exerted by a return spring of said single shot trigger, said slide is moved forward, and the gun shoots continuously as long as said continuous shooting trigger is depressed.

4. A real gun or a toy gun comprising:

a gun frame;

a single shot trigger for shooting said gun each time said single shot trigger is depressed;

a slide which is moved first to a rearward position and then to a forward position to supply a bullet each time the gun is fired, and a detachably mounted continuous shooting device including:

a mounting unit detachably mounted on said gun frame, said mounting unit including a substantially box-shaped main body member partially surrounding a lower portion of the gun frame and a fixing member detachably mounted on the main body member with screws;

a continuous shooting trigger installed on said mounting unit and movable back and forth against said mounting unit and having an extension being extended forward;

an operating member which is installed on said mounting unit and is movable back and forth against said mounting unit and is brought into contact with said single shot trigger; and a connecting member pivotally connected to said forward extension of said continuous shooting trigger at its central portion and pivotally connected to said operating member at its lower portion, said connecting member having:

an engaging portion formed at an upper end of said connecting member, wherein said engaging portion contacts the front surface of a lower part of said slide when said slide is in the forward position such that when said continuous shooting trigger is depressed, said single shot trigger is depressed by said operating member so as to shoot a bullet, said slide is moved back, said operating member and said single shot trigger are returned to initial rest positions under the influence of a resilient force exerted by a return spring of said single shot trigger, said slide is moved forward, and the gun shoots continuously as long as said continuous shooting trigger is depressed.

* * * * *